US006640725B2

(12) United States Patent
Theurer et al.

(10) Patent No.: US 6,640,725 B2
(45) Date of Patent: Nov. 4, 2003

(54) TRACK WORK MACHINE

(75) Inventors: Josef Theurer, Vienna (AT); Bernhard Lichtberger, Leonding (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 10/167,193

(22) Filed: Jun. 11, 2002

(65) Prior Publication Data

US 2003/0010248 A1 Jan. 16, 2003

(30) Foreign Application Priority Data

Jul. 10, 2001 (AT) ..... 546/2001 U

(51) Int. Cl.[7] ..... E01B 27/00
(52) U.S. Cl. ..... 104/2
(58) Field of Search ..... 104/2, 4, 5, 7.1, 104/7.3

(56) References Cited

U.S. PATENT DOCUMENTS 5,357,867 A * 10/1994 Theurer et al. ..... 104/2
5,566,619 A * 10/1996 Theurer ..... 104/2

FOREIGN PATENT DOCUMENTS

| | | |
|---|---|---|
| AT | 387 999 B | 4/1989 |
| JP | 2000257003 A | 9/2000 |
| JP | 2000290904 A | 10/2000 |

* cited by examiner

*Primary Examiner*—S. Joseph Morano
*Assistant Examiner*—Robert J. McCarry, Jr.
(74) *Attorney, Agent, or Firm*—Henry M. Feiereisen

(57) ABSTRACT

A track work machine for mobility on a track extending in a longitudinal direction and supported on ballast, includes a machine frame extending in the longitudinal direction and having a front end and a rear end. An excavating device is mounted on the machine frame at the rear end and has a leading ballast pick-up unit arranged underneath the track and a trailing discharging end. A conveyor belt is associated with the discharging end and provided for receiving and transporting excavated ballast. A front undercarriage and a rear undercarriage are provided for supporting the machine frame on the track, the rear undercarriage being mounted on the machine frame for displacement in the longitudinal direction from a transit travel position, in which the rear undercarriage is situated between the discharging end and the ballast pick-up unit of the excavating device, in the direction towards the front undercarriage.

8 Claims, 1 Drawing Sheet

TRACK WORK MACHINE

CROSS-REFERENCES TO RELATED APPLICATIONS

This application claims the priority of Austrian utility model no. GM 546/2001, filed Jul. 10, 2001, the subject matter of which is incorporated herein by reference.

BACKGROUND OF THE INVENTION

The present invention relates, in general, to a track work machine which is mobile on a track and includes a machine frame supported on the track by undercarriages and having an excavating device with a ballast pick-up unit arranged underneath the track.

A track work machine of this kind is described in Japanese publication No. JP 2000257003 A. Arranged at the rear end of the machine frame is an excavating device, which is formed by an endless clearing chain looped around the track during working operations. The clearing chain is arranged so as to protrude from the machine frame beyond the rear undercarriage and designed to be pivotable upwards by means of a complicated structure to assume an inoperative position on the machine frame during transit travel of the machine.

Japanese publication No. JP 2000290904 A describes a track work machine with an excavating device with no separate apparatus for adjusting the excavating device. In order to prevent the clearing chain from being subjected to excessive load during working operations, it is necessary to provide additional support rollers, running on the track, which are situated in front of the excavating device with regard to the operating direction.

Austrian Pat. No. AT 387 999 B describes a large, high-efficiency ballast cleaning machine having an excavating device positioned between undercarriages supporting the machine frame on the track. One of these undercarriages, arranged centrally, is designed to be adjustable in the direction of longitudinal extension of the machine relative to the machine frame in order to thereby extend the construction area or renewal gap during working operations. With this design, it is possible to lift the track to a higher extent, and to achieve a more gentle deflection curve of the rails during the track lifting process.

It would be desirable and advantageous to provide an improved track work machine of the afore-described type, which has a compact configuration and simple construction while still being reliable in operation.

SUMMARY OF THE INVENTION

According to one aspect of the present invention, a track work machine includes a machine frame extending longitudinally in the direction of the track and having a front end and a rear end with regard to an operating direction of the machine, an excavating device mounted at the rear end of the machine frame and having a leading ballast pick-up unit, which is arranged underneath the track, and a trailing discharging end, a conveyor belt associated with the discharging end and provided for receiving and transporting excavated ballast, and a front undercarriage and a rear undercarriage for support of the machine frame on the track, wherein the rear undercarriage is mounted on the machine frame for displacement in the longitudinal direction from a transit travel position, in which the rear undercarriage is situated between the discharging end and the ballast pick-up unit of the excavating device, in the direction towards the front undercarriage.

The present invention resolves prior art problems associated with an excessive overhang, i.e. the portion of the machine projecting over the undercarriage situated at the end, without adversely affecting the efficiency of the excavating device during operation, by providing a displaceable design of the rear undercarriage. Required retooling operations on the machine can be reduced to a minimum in an ergonomically advantageous way that also adds to the operator's safety.

BRIEF DESCRIPTION OF THE DRAWING

Other features and advantages of the present invention will be more readily apparent from the following detailed description of currently preferred exemplified embodiments of the invention with reference to the accompanying drawing, in which the dole

DETAILED DESCRIPTION OF A PREFERRED EMBODIMENT

Figure 1:
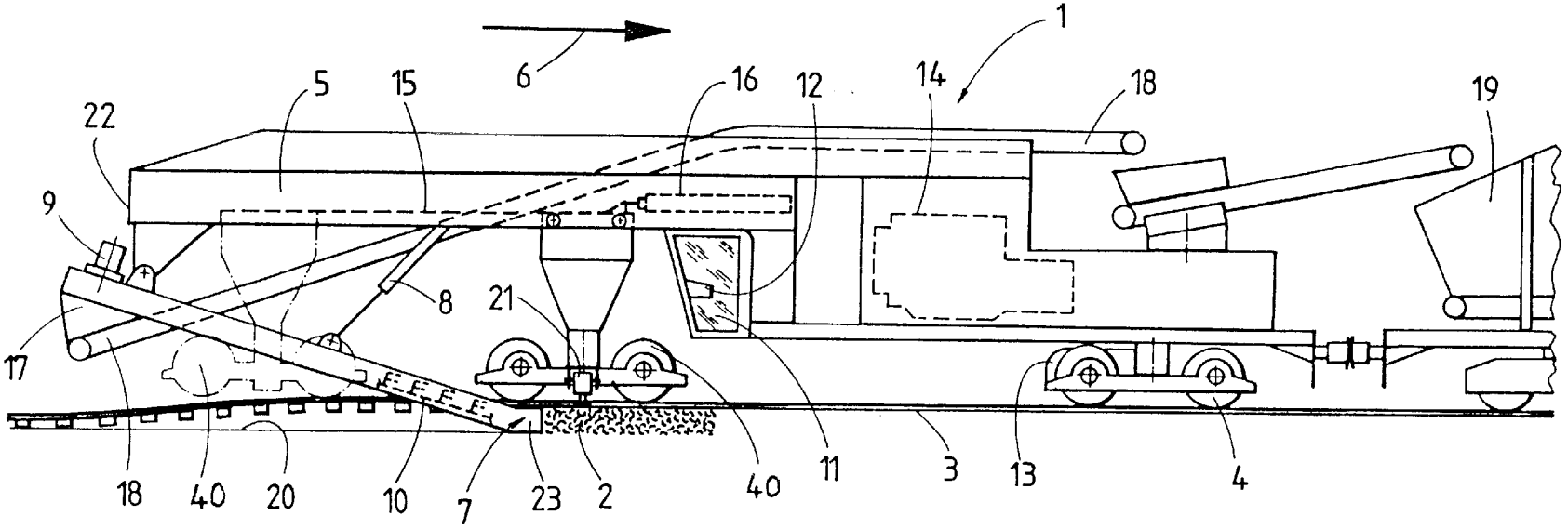
FIG. 1 shows a side elevational view of a track work machine designed in accordance with the present invention.

Turning now to the FIG. 1, there is shown a track work machine according to the present invention, generally designated by reference numeral 1 and constructed for mobility on a track 3 in an operating direction indicated by arrow 6. The track 3 is supported on ballast 2 and extends in a longitudinal direction. The track work machine 1 is designed for picking up ballast 2 from the track 3 and includes a machine frame 5 supported on the track by a front undercarriage 4 and a rear undercarriage 40. As viewed in the operating direction 6, an excavating device 7 is arranged at a (trailing) rear end 22 of the machine frame 5 and includes a clearing chain 10, which is guided endlessly around the track 3. The clearing chain 10 includes a leading ballast pick-up unit 23 and a trailing discharging end 17. The clearing chain 10 is vertically adjustable as well as rotatable by means of drives 8,9. An operator's cabin 11 including a control device 12 is situated between the front undercarriage 4 and the rear undercarriage 40. All the drives of the machine 1 as well as motive drive 13 for advancing the track work machine 1 along the track 3 are supplied with energy by a power unit 14 which is arranged on the machine frame 5.

During transit travel of the track work machine 1, the rear undercarriage 40 is positioned at the rear end 22 between the ballast pick-up unit 23 and the discharging end 17. The rear undercarriage 40 is mounted in a longitudinal guide 15, which is arranged on the machine frame 5 and extends in the longitudinal direction, for displacement of the rear undercarriage 40 in the direction of longitudinal extension of the machine 1. A drive 16 is provided to effect the longitudinal displacement of the rear undercarriage 40 relative to the machine frame 5. Of course, it is also conceivable to design the connection between the rear undercarriage 40 and the machine frame 5 in such a way that the longitudinal displacement can be accomplished by means of the motive drive 13.

During working operations, the rear undercarriage 40 is shifted forwards in the direction towards the front undercarriage 4, from a transit travel position shown in dash-dotted lines into a working position drawn in full lines. In the working position, the rear undercarriage 40 is situated in the region of the ballast pick-up unit 23, which has already been put into its operating position in the track 3. Ballast 2, removed at this point by the clearing chain 10, is unloaded via the discharging end 17 of the excavating device 7 onto a conveyor belt 18 arranged on the machine frame 5. In further sequence, the ballast 2 is transported onwards in the longitudinal direction by the conveyor belt 18 to a storage wagon 19, which is coupled to the front end of the machine 1 and shown here only fragmentary.

After passage of the machine 1, the track 3 is laid down upon a formation 20, which has been created as a result of the clearing action of the clearing chain 10. In order to additionally relieve the clearing chain 10 of load, a track lifting device 21 for holding the track 3 is arranged on the displaceable rear undercarriage 4.

While the invention has been illustrated and described as embodied in a track work machine, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A track work machine adapted for mobility on a track supported on ballast and extending in a longitudinal direction, comprising a machine frame extending in the longitudinal direction and having a front end and a rear end with regard to an operating direction of the machine;

an excavating device mounted on the machine frame at the rear end and having a ballast pick-up unit arranged underneath the track and a discharging end positioned rearwardly with regard to the operating direction;

a conveyor belt associated with the discharging end and provided for receiving and transporting excavated ballast; and a front undercarriage and a rear undercarriage supporting the machine frame on the track, the rear undercarriage being mounted on the machine frame for displacement in the longitudinal direction relative to the machine frame from a transit travel position, in which the rear undercarriage is situated between the discharging end and the ballast pick-up unit of the excavating device, in the direction towards the front undercarriage.

2. The track work machine of claim 1, and further comprising a drive connected to the rear undercarriage and provided for the longitudinal displacement thereof.

3. The track work machine of claim 1, and further comprising a track lifting device connected to the rear undercarriage.

4. The track work machine of claim 1, and further comprising a longitudinal guide arranged on the machine frame and extending in the longitudinal direction and connected to the rear undercarriage.

5. A track work machine, comprising:

a machine frame supported on undercarriages for mobility along a track in an operating direction; and an excavating device mounted to the machine frame and including a leading ballast pick-up unit and a trailing discharging end for transfer of ballast onto a conveyor belt, wherein one of the undercarriages is supported by the machine frame for displacement direction relative to the machine frame between a transit travel position, in which the one undercarriage is situated between the discharging end and the ballast pick-up unit of the excavating device, and a working position, in which the one undercarriage is moved forward along the track to a position beyond the ballast pick-up unit.

6. The track work machine of claim 5, and further comprising a drive for moving the one undercarriage between the transit travel and working positions.

7. The track work machine of claim 5, and further comprising a track lifting device connected to the one undercarriage.

8. The track work machine of claim 5, and further comprising a guide, arranged longitudinally along the machine frame and configured for guising the one undercarriage during displacement between the transit travel and working positions.

* * * * *